US011804678B2

(12) United States Patent
Zhou et al.

(10) Patent No.: US 11,804,678 B2
(45) Date of Patent: Oct. 31, 2023

(54) POWER SUPPLY ADAPTER

(71) Applicant: Chengli Li, Suzhou (CN)

(72) Inventors: Junwu Zhou, Suzhou (CN); Degui Zhao, Suzhou (CN)

(73) Assignee: Chengli Li, Suzhou (CN)

( * ) Notice: Subject to any disclaimer, the term of this patent is extended or adjusted under 35 U.S.C. 154(b) by 380 days.

(21) Appl. No.: 17/368,779

(22) Filed: Jul. 6, 2021

(65) Prior Publication Data

US 2022/0416481 A1 Dec. 29, 2022

(30) Foreign Application Priority Data

Jun. 23, 2021 (CN) ..... 202110696530.4
Jun. 23, 2021 (CN) ..... 202121397666.7

(51) Int. Cl.

| | |
|---|---|
| ***H01R 13/66*** | (2006.01) |
| ***H01R 31/06*** | (2006.01) |
| ***H01R 13/652*** | (2006.01) |
| ***H01R 27/00*** | (2006.01) |
| *H01R 103/00* | (2006.01) |

(52) U.S. Cl.
CPC ..... *H01R 13/6675* (2013.01); *H01R 13/652* (2013.01); *H01R 27/00* (2013.01); *H01R 31/065* (2013.01); *H01R 2103/00* (2013.01)

(58) Field of Classification Search
CPC ... H01R 13/6675; H01R 13/652; H01R 27/00
See application file for complete search history.

(56) References Cited

U.S. PATENT DOCUMENTS 2,792,557 A * 5/1957 Dowick ..... H01R 25/006 439/652
3,131,013 A * 4/1964 Carlson ..... H01R 13/648 439/365
3,381,258 A * 4/1968 Becker, Jr. ..... H01R 13/6215 439/107
3,382,355 A * 5/1968 Prifogle ..... H01R 13/717 D13/137.1
3,739,317 A * 6/1973 Wise ..... H01R 27/00 439/103
3,775,727 A * 11/1973 Wise ..... H01R 31/06 439/652
3,924,914 A * 12/1975 Banner ..... G01R 31/58 439/490

(Continued)

*Primary Examiner* — Neil Abrams
(74) *Attorney, Agent, or Firm* — Chen Yoshimura LLP

(57) ABSTRACT

A power supply adapter includes a base plate, an electrical connector assembly disposed on the base plate, a support frame, a circuit board, and a shell body. The electrical connector assembly includes a hot connector assembly, a neutral connector assembly, and a ground connector assembly. When the adapter is plugged into a two-prong socket, the ground connector assembly is grounded to the two-prong socket. The support frame covers the electrical connector assembly and is affixed to the base plate. The circuit board is disposed on the support frame and electrically coupled to the electrical connector assembly. The shell body covers the support frame and circuit board and is affixed to the base plate. The power supply adapter can used with two-prong sockets that lack a ground slot, and provides grounding test function after being plugged into the two-prong socket, making it safe and convenient to use.

10 Claims, 8 Drawing Sheets

(56) References Cited

U.S. PATENT DOCUMENTS

| | | | | |
|---|---|---|---|---|
| 4,111,516 | A * | 9/1978 | Wireman | H01R 13/648 324/508 |
| 4,897,049 | A * | 1/1990 | Miller | H01R 25/006 439/652 |
| 9,190,778 | B2 * | 11/2015 | Harris | H01R 13/652 |
| 2022/0416481 | A1 * | 12/2022 | Zhou | H01R 13/652 |

* cited by examiner

POWER SUPPLY ADAPTER

BACKGROUND OF THE INVENTION

Field of the Invention

This invention relates to home power supplies, and in particular, it relates to a power supply adapter.

Description of Related Art

With the wide use of home electrical appliances, electrical safety has become more important. However, today there are still old buildings that use old power supply sockets, such as sockets that only accommodate two prongs. Using these old two-prong power supply sockets, electrical appliances cannot be properly grounded, which is a safety risk.

More specifically, there are some two-prong to three-prong socket adapters on the market today, but they do not have a grounding function, and are only "sham" grounding sockets. Because they do not have true grounding functions, the electrical appliance plugged into them cannot be properly grounded. They may mislead users into believing that such three-prong adapter sockets has a grounding function, which may present a safety risk to the user.

In some conventional power supply adapters, the grounding plate is fixed, and cannot be adjusted, so that they can only work with particular sockets. Such devices lack universal applicability and are inconvenient to use. Moreover, many home power supply sockets do not have reliable grounding, or even do not have a ground line at all, but the user is unable to determine whether the sockets has proper grounding. This causes uncertainty for the user and presents safety risks.

Therefore, there is a need for a power supply adapter that is easy to install and cost effective.

SUMMARY

To solve the above problems, the present invention provides a power supply adapter, including: a base plate, an electrical connector assembly disposed on the base plate, a support frame, a circuit board, and a shell body. The electrical connector assembly includes a hot connector assembly, a neutral connector assembly, and a ground connector assembly. When the power supply adapter is plugged into a two-prong socket, the ground connector assembly is grounded to the two-prong socket. The support frame is disposed to cover the electrical connector assembly and affixed to the base plate. The circuit board is disposed on the support frame and electrically coupled to the electrical connector assembly. The shell body is disposed to cover the support frame and circuit board and affixed to the base plate.

In one embodiment, the ground connector assembly includes:

- a ground connector plate, having one or more ground jaws formed at one end and a ground ring receiving member formed at another end;
- a ground ring, removably disposed in the ground ring receiving member; and
- a ground screw, configured to press the ground connector plate and the ground ring into tight contact with each other, wherein when the power supply adapter is plugged into the two-prong socket, the ground screw is configured to be screwed into a ground hole of the two-prong socket to keep the ground connector plate and the ground ring in electrical contact with the ground hole of the two-prong socket, whereby the power supply adapter is grounded.

In one embodiment, the hot connector assembly includes:

- a hot connector plate, having one or more hot jaws formed at one end; and
- a hot insertion plate, having a hot prong formed at one end which is adapted to be inserted into an insertion slot of the two-prong socket, and having a first tab formed at another end which is coupled to the hot connector plate.

In one embodiment, the neutral connector assembly includes:

- a neutral connector plate, having one or more neutral jaws formed at one end; and
- a neutral insertion plate, having a neutral prong formed at one end which is adapted to be inserted into another insertion slot of the two-prong socket, and a second tab formed at another end which is coupled to the neutral connector plate.

In one embodiment, a position of the ground ring relative to the ground ring receiving member is adjustable.

In one embodiment, the shell body includes:

- one or more hot prong insertion slots, disposed on a first surface of the shell body, each corresponding to a position of one of the one or more hot jaws;
- one or more neutral prong insertion slots, disposed on the first surface of the shell body, each corresponding to a position of one of the one or more neutral jaws;
- one or more ground prong insertion slots, disposed on the first surface of the shell body, each corresponding to a position of one of the one or more ground jaws; and
- at least one Universal Serial Bus (USB) slot, disposed on a second surface of the shell body which is different from the first surface.

In one embodiment, the power supply adapter further includes:

- a grounding test circuit disposed within the shell body and electrically coupled to the circuit board, configured to test a grounding condition of the power supply adapter.

In one embodiment, the ground ring receiving member includes:

- a receiving plate configured to receive the ground ring;
- a pair of clamps disposed respectively on two sides of the receiving plate, configured to secure the ground ring to the receiving plate; and
- a first receiving trough formed in the receiving plate, configured to cooperate with the ground ring and the ground screw.

In one embodiment, the ground ring includes:

- a ground ring plate; and
- a second receiving trough formed in the ground ring plate and configured to cooperate with the first receiving trough and the ground screw.

In one embodiment, when the ground ring is disposed in the ground ring receiving member, the ground ring plate is affixed by the pair of clamps to the ground ring receiving member at a first position, and wherein the first receiving trough cooperates with the second receiving trough, and the ground screw is adapted to passes through the first receiving trough and the second receiving trough to be screwed into the ground hole of the two-prong socket.

In one embodiment, when the ground ring is disposed in the ground ring receiving member, the ground ring plate is affixed by the pair of clamps to the ground ring receiving member at a second position different from the first position, and wherein the first receiving trough cooperates with the second receiving trough, and the ground screw is adapted to passes through the first receiving trough and the second receiving trough to be screwed into the ground hole of the two-prong socket.

Compared to conventional technology, the power supply adapter according to embodiments of the present invention can be used with existing two-prong sockets, by installing it on the two-prong sockets and connecting it to the grounding components of the two-prong sockets, in order to provide grounding for the electrical appliances plugged into the adapter, eliminating safety risk for the user. On the other hand, the adapter can also provide an USB connector slot. Compared to conventional adapters, in the adapter described here, the position of the USB slot is advantageous in that it reduces dust accumulation and hence reduces shorting problems, and also, when other electrical plugs are simultaneously plugged in the adapter, the USB slot is not blocked, making it easy to use.

BRIEF DESCRIPTION OF THE DRAWINGS

Preferred embodiments of the present invention are described with reference to the drawings. These drawings serve to explain the embodiments and their operating principle, and only illustrate structures that are necessary to the understanding of the principles of the invention. These drawings are not necessarily to scale. In the drawings, like features are designated by like reference symbols.

DETAILED DESCRIPTION OF PREFERRED EMBODIMENTS

Preferred embodiments of the present invention are described below with reference to the drawings. These drawings and descriptions explain embodiments of the invention but do not limit the invention. The described embodiments are not all possible embodiments of the present invention. Other embodiments are possible without departing from the spirit and scope of the invention, and the structure and/or logic of the illustrated embodiments may be modified. Thus, it is intended that the scope of the invention is defined by the appended claims.

The power supply adapter according to embodiments of the present invention mainly concerns the following technical problem: when using a two-prong socket without a grounding function, how to design a power supply adapter that achieves a grounding function, so as to eliminate safety risks.

To solve the above problems, embodiments of the present invention provides a power supply adapter which includes a base plate, an electrical connector assembly disposed on the base plate, a support frame, a circuit board, and a shell body. The electrical connector assembly includes a hot connector assembly, a neutral connector assembly, and a ground connector assembly. When the adapter is plugged into a two-prong socket, the ground connector assembly is grounded to the two-prong socket. The support frame covers the electrical connector assembly and is affixed to the base plate. The circuit board is disposed on the support frame and electrically coupled to the electrical connector assembly. The shell body covers the support frame and circuit board and is affixed to the base plate.

Figure 1:
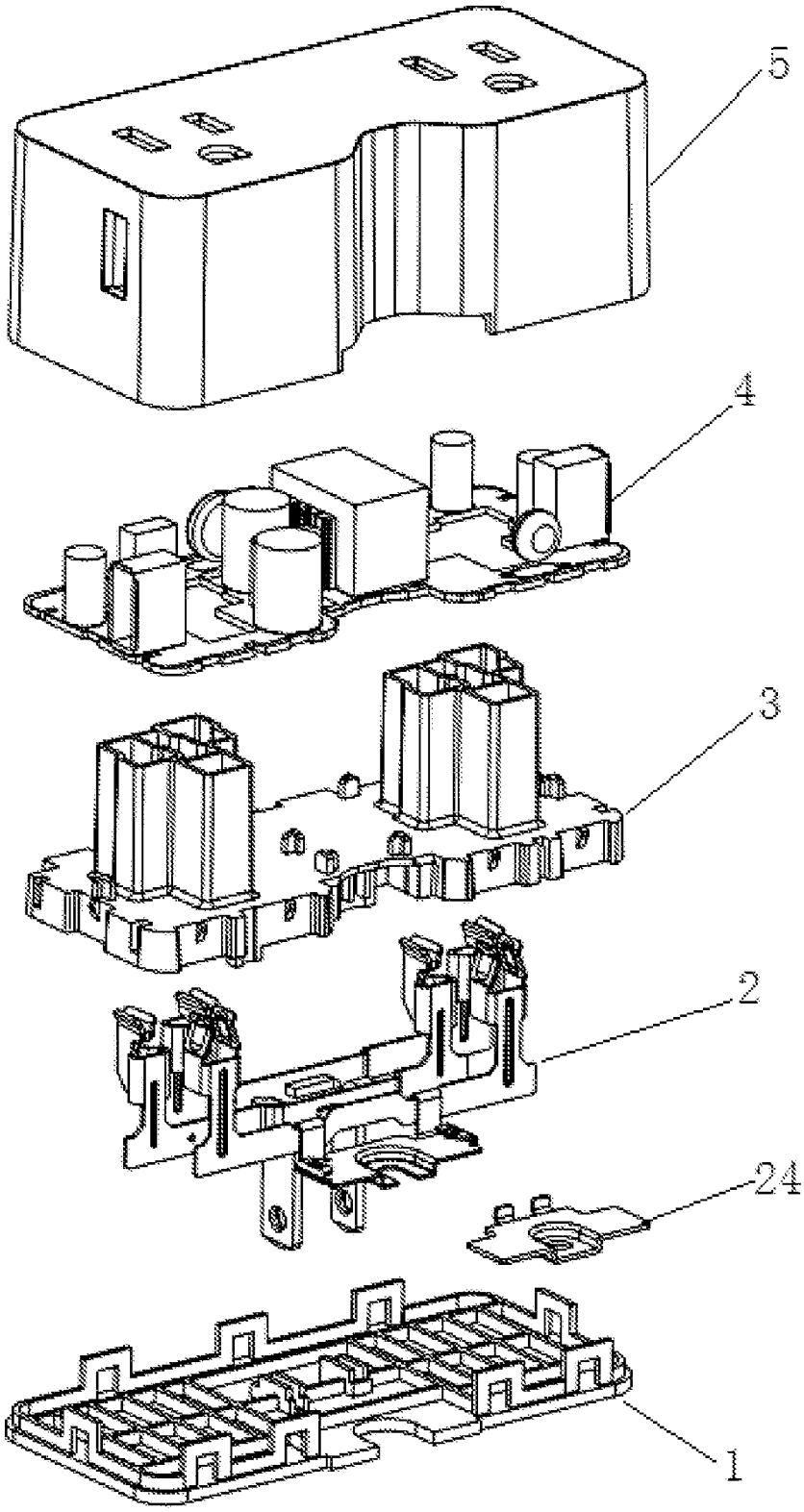
FIG. 1 is an exploded view of a power supply adapter according to an embodiment of the present invention.

As shown in FIG. 1, the power supply adapter according to an embodiment of the present invention includes a base plate 1, an electrical connector assembly 2 disposed on the base plate 1, a support frame 3, a circuit board 4 disposed on the support frame 3, and a shell body 5. More specifically, the electrical connector assembly 2 is disposed on the base plate 1, and the neutral and hot prongs of the electrical connector assembly 2 pass through the base plate 1 to be exposed to the exterior below the base plate 1. The support frame 3 covers the electrical connector assembly 2 and is affixed to the base plate 1. The support frame 3 includes protruding parts that surround the receiving jaws of the electrical connector assembly 2 while providing openings for prongs of an electrical plug to be inserted into the jaws. The circuit board 4 is disposed on the support frame 3 and electrically coupled to the electrical connector assembly 2. The circuit board 4 has openings that allow the protruding parts of the support frame 3 to pass though. The shell body 5 is disposed above the support frame 3 and circuit board 4 to cover them, and affixed to the base plate 1.

The electrical connector assembly 2 includes a hot connector assembly, a neutral connector assembly, and a ground connector assembly, all formed of conductive materials. When the power supply adapter is plugged into a two-prong socket 7 (see FIG. 4B), the ground connector assembly is electrically coupled to the grounding components of the two-prong socket 7.

Figure 2A:
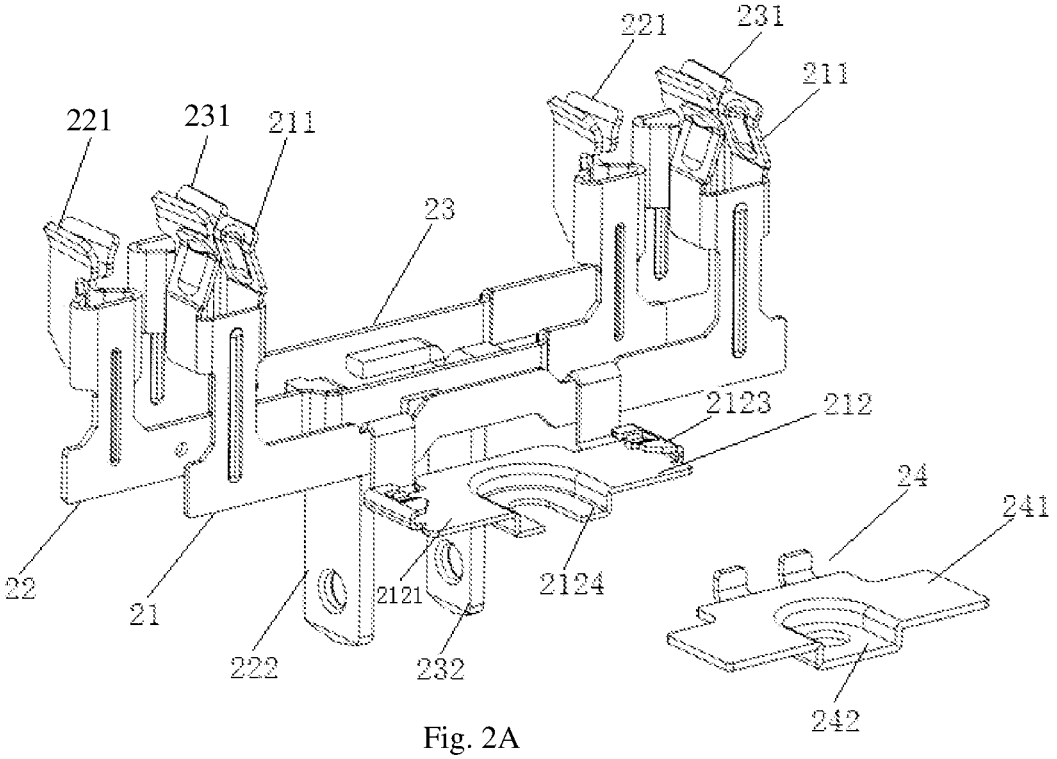
FIG. 2A is a perspective view of an electrical connector assembly of the power supply adapter of the embodiment.
Figure 2B:
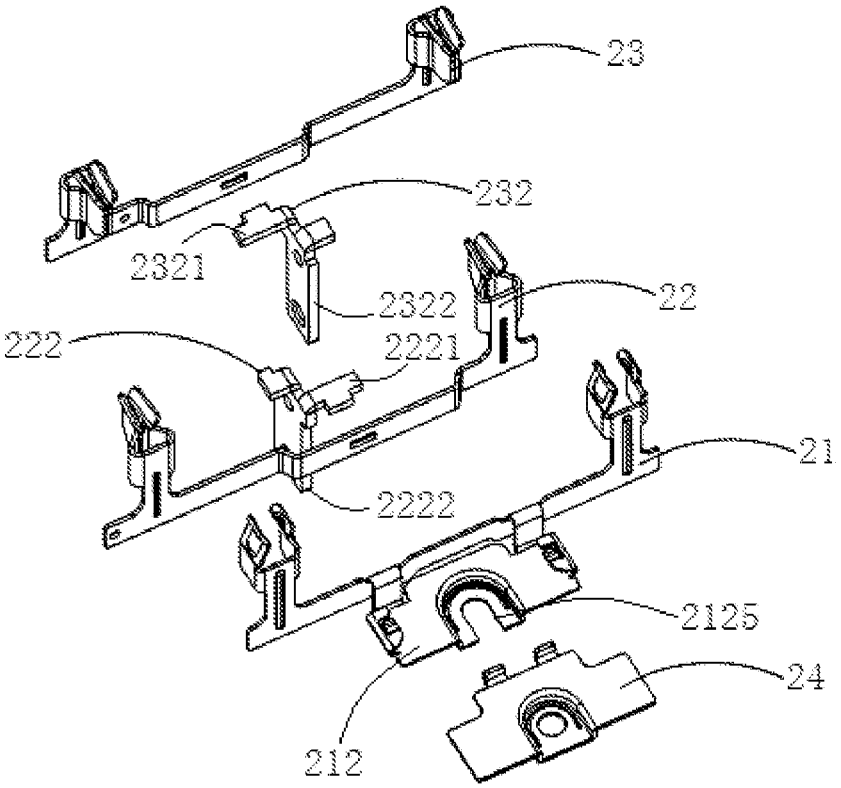
FIG. 2B is an exploded view of the electrical connector assembly of the power supply adapter of the embodiment.

As shown in FIGS. 2A and 2B, the hot connector assembly includes a hot connector plate 23 and a hot insertion plate 232. One end (the upper end in the drawings) of the hot connector plate 23 forms one or more hot jaws 231 configured to receive prongs of an electrical plug. One end (the lower end in the drawings) of the hot insertion plate 232 forms a hot prong 2322 configured to be inserted into an insertion slot 72 of the two-prong socket 7 (see FIG. 4B). The other end (the upper end in the drawings) of the hot insertion plate 232 forms a first tab 2321 which is coupled to the hot connector plate 23.

The neutral connector assembly includes a neutral connector plate 22 and a neutral insertion plate 222. One end (the upper end in the drawings) of the neutral connector plate 22 forms one or more neutral jaws 221 configured to receive prongs of an electrical plug. One end (the lower end in the drawings) of the neutral insertion plate 222 forms a neutral prong 2222 configured to be inserted into another insertion slot 72 of the two-prong socket 7. The other end (the upper end in the drawings) of the neutral insertion plate 222 forms a second tab 2221 which is coupled to the neutral connector plate 22.

In this embodiment, one end of the hot connector plate 23 forms one or more hot jaws 231, and one end of the neutral connector plate 22 forms one or more neutral jaws 221. The hot connector plate 23 and the hot jaws 231 are formed integrally. The neutral connector plate 22 and the neutral jaws 221 are formed integrally. Further, in practice, depending on the size of the power supply adapter, the hot connector plate 23 and neutral connector plate 22 may have any desired number of hot jaws 231 and neutral jaws 221.

Figure 3A:
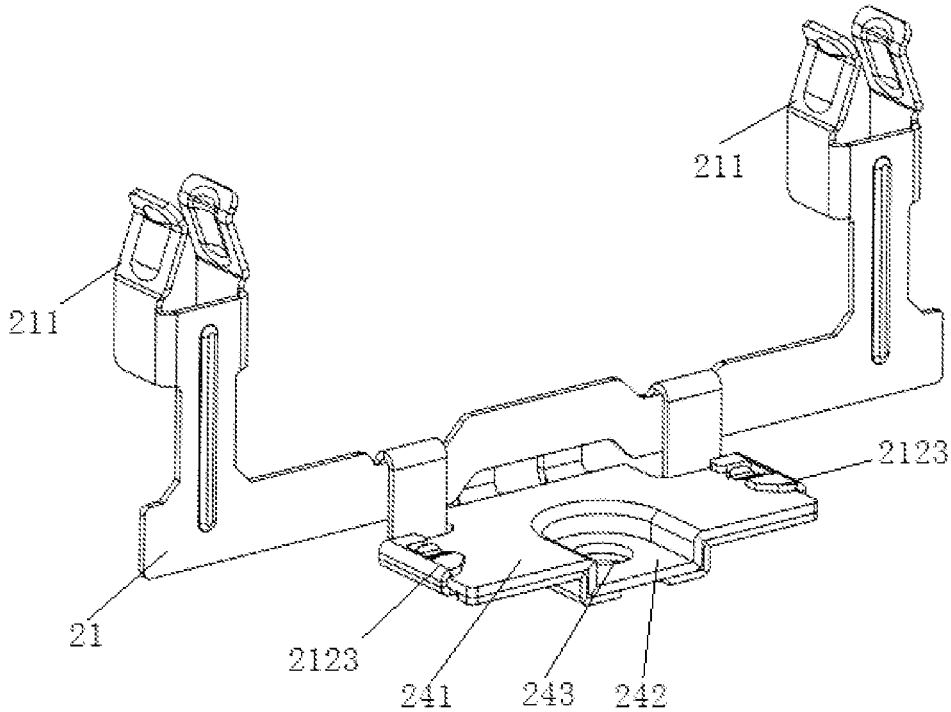
FIGS. 3A and 3B are perspective views of a ground connector assembly of the power supply adapter of the embodiment.
Figure 3B:
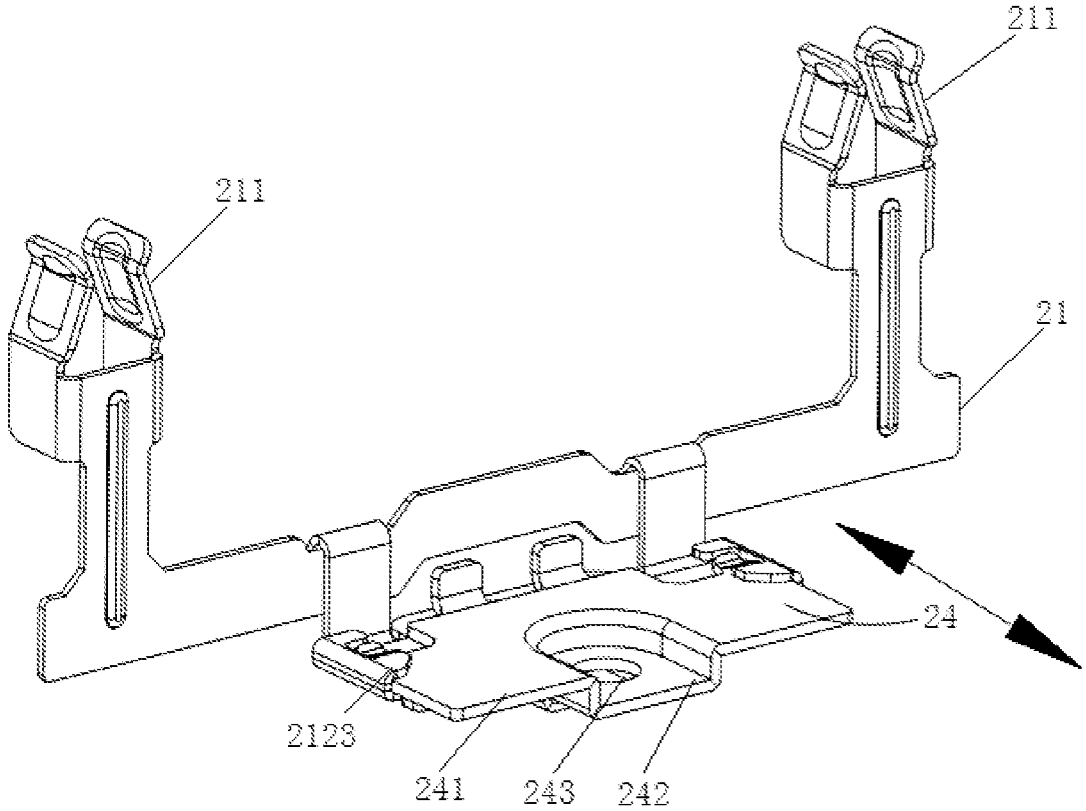
Figure 4A:
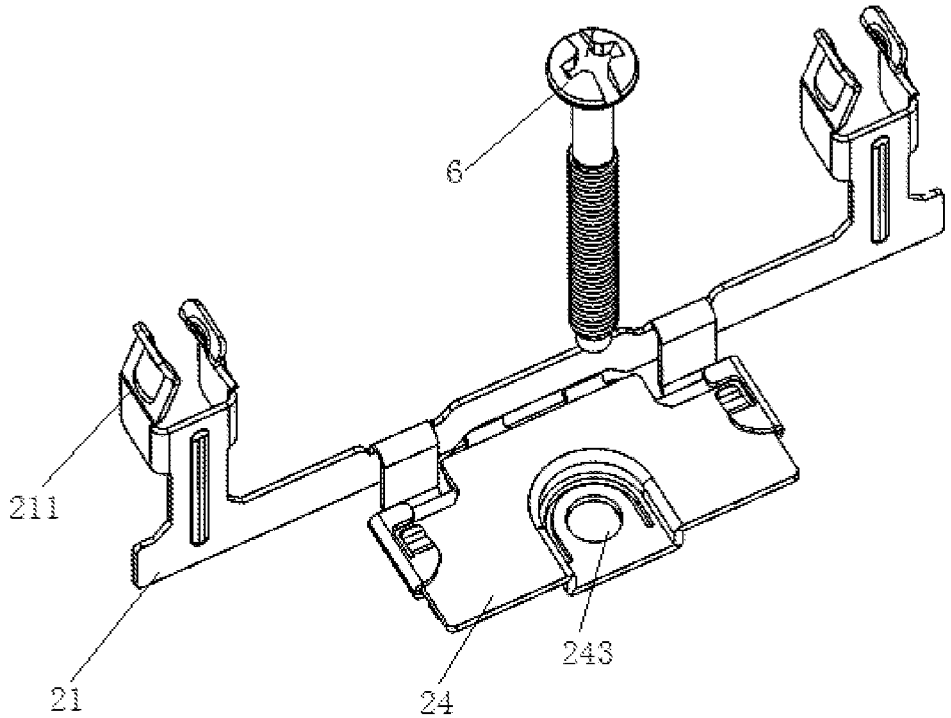
FIGS. 4A and 4B illustrate the ground connector assembly of the power supply adapter of the embodiment cooperating with a two-prong power supply socket.

As shown in FIGS. 2A-4A, the ground connector assembly includes a ground connector plate 21, a ground ring 24 and a ground screw 6. In this embodiment, one end (the upper end in the drawings) of the ground connector plate 21 forms one or more ground jaws 211 configured to receive prongs of an electrical plug; another end (the lower end in the drawings) of the ground connector plate 21 forms a ground ring receiving member 212. The ground ring 24 is removably attached to the ground ring receiving member 212, and the ground screw 6 presses the ground connector plate 21 and ground ring 24 into tight contact with each other. Further, as shown in FIGS. 4A and 4B, when the power supply adapter is plugged into the two-prong socket 7, the ground screw 6 is securely screwed into the ground hole 71 of the two-prong socket 7, so that the ground connector plate 21 and ground ring 24 are in electrical contact with the grounding components of the two-prong socket 7. Therefore, the power supply adapter is grounded.

In this embodiment, one end of the ground connector plate 21 forms one or more ground jaws 211. Similar to the structures of the hot connector plate 23 and neutral connector plate 22, the ground connector plate 21 and the ground jaws 231 are formed integrally. This reduces the grounding resistance, and enhances safety and reliability of the grounding of the devices plugged into the power supply adapter. In practice, depending on the size of the power supply adapter, the ground connector plate 21 may have any desired number of ground jaws 211.

As shown in FIGS. 2A-3B, the ground ring receiving member 212 includes a receiving plate 2121 configured to receive the ground ring 24, a pair of clamps 2123 disposed respectively on two sides of the receiving plate 2121, and a first receiving trough 2124 formed in the receiving plate 2121.

The pair of clamps 2123 are configured to secure the ground ring 24 to the receiving plate 2121. The first receiving trough 2124 is configured to cooperate with the ground ring 24 and the ground screw 6.

Further, as shown in the drawings, the first receiving trough 2124 has an elongated opening 2125 (labeled in FIG. 2B).

The ground ring 24 includes a ground ring plate 241 and a second receiving trough 242. More specifically, the second receiving trough 242 is formed in the ground ring plate 241 and configured to cooperate with the first receiving trough 2124 and the ground screw 6.

Further, in this embodiment, the second receiving trough 242 has an instillation through hole 243 (labeled in FIG. 3A), which cooperates with the opening 2125 of the first receiving trough 2124, so that the ground screw 6 can pass through the instillation through hole 243, the opening 2125 and the ground hole 71 to securely attach the ground connector plate 21 to the two-prong socket 7.

The ground ring 24 is adjustably disposed on the ground connector plate 21, so as to adapt to different two-prong sockets that may have different distances between the ground screw and the insertion holes. This improves the versatility of the power supply adapter.

In this embodiment, based on the position of the ground hole 71 of the two-prong socket 7, the position of the ground ring 24 relative to the ground ring receiving member 212 is adjusted, so that the ground screw 6 can properly affix the ground connector plate 21 and ground ring 24 via the ground hole 71.

FIGS. 3A and 3B shows the relative positions of the ground ring 24 on the ground ring receiving member 212 in two different situations, respectively for plugging into two different two-prong sockets 7 with different distances between the slots 72 and the ground hole 71. As shown in FIG. 3A, when the ground ring 24 is disposed in the ground ring receiving member 212, the ground ring plate 241 is affixed to a first position of the ground ring receiving member 212 by the pair of clamps 2123, and the first receiving trough 2124 cooperates with the second receiving trough 242. In this position, when the hot insertion plate 232 and neutral insertion plate 222 are inserted into the slots of the two-prong socket, the ground screw 6 passes through the first receiving trough 2124 and the second receiving trough 242 (through the instillation through hole 243 and the opening 2125) to be screwed into the ground hole.

As shown in FIG. 3B, when the ground ring 24 is disposed in the ground ring receiving member 212, the ground ring plate 241 maybe affixed to a second position of the ground ring receiving member 212 by the pair of clamps 2123, the second position being different from the first position. At this position, the first receiving trough 2124 cooperates with the second receiving trough 242, so that when the hot insertion plate 232 and neutral insertion plate 222 are inserted into the slots of another two-prong socket, the ground screw 6 passes through the first receiving trough 2124 and the second receiving trough 242 (through the instillation through hole 243 and the opening 2125) to be screwed into the ground hole.

Figure 4B:
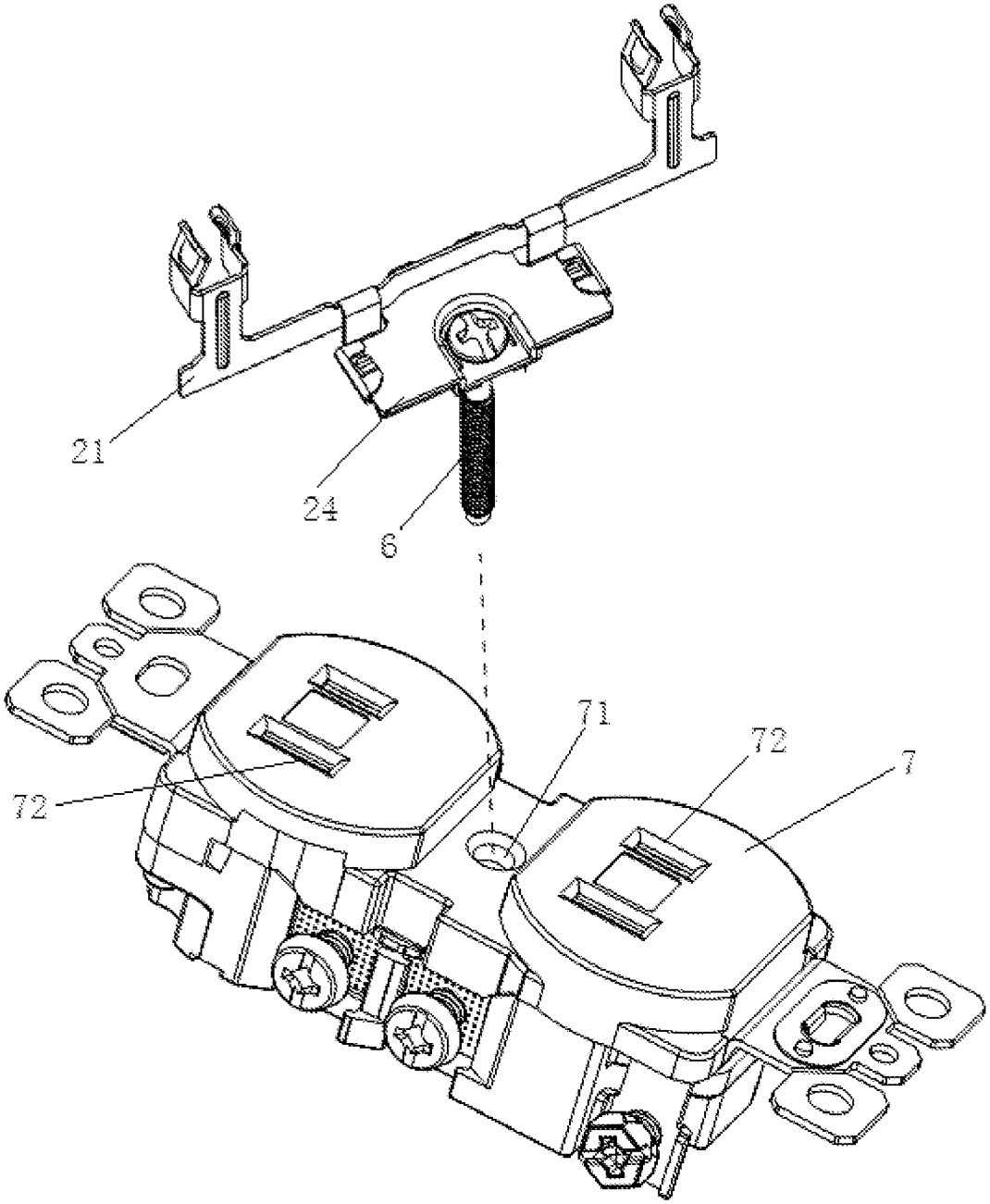

Thus, as shown in FIG. 4B, based on the position of the ground hole 71 of the two-prong socket 7 relative to the insertion slots 72, the position of the ground ring 24 relative to the ground ring receiving member 212 is adjusted, which changes the position of the instillation through hole 243 relative to the opening 2125, so that the ground screw 6 passes through the instillation through hole 243 and the opening 2125 to be screwed into the ground hole 71 of the two-prong socket 7, to achieve reliable grounding.

Figure 5A:
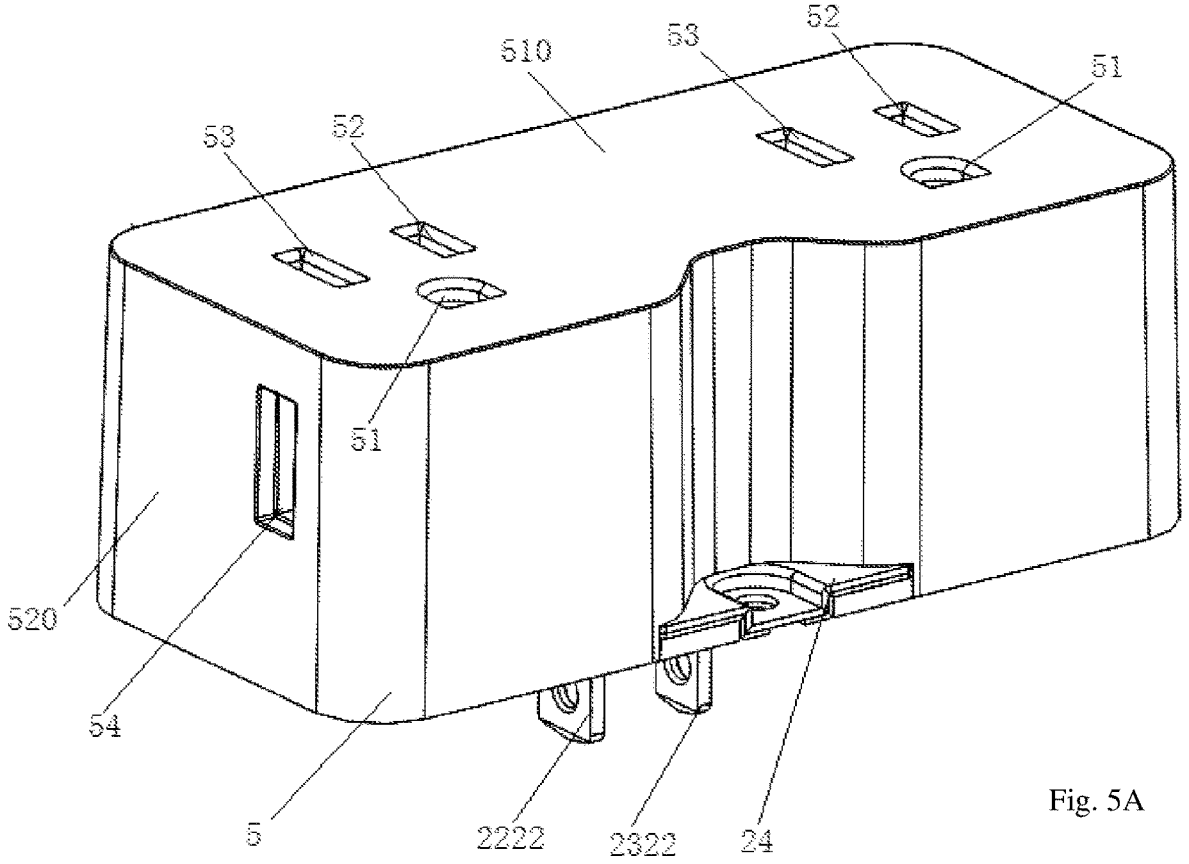
FIGS. 5A and 5B illustrate exterior views of the power supply adapter according to embodiments of the present invention.

The shell body 5 includes at least one hot prong insertion slot 53, at least one neutral prong insertion slot 52, at least one ground prong insertion slot 51, and optionally, at least one USB connector slot 54. The embodiment shown in FIGS. 5A and 5B includes two hot prong insertion slots 53, two neutral prong insertion slots 52, two ground prong insertion slots 51, and at least one USB slot 54. The hot prong insertion slots 53, neutral prong insertion slots 52, and ground prong insertion slots 51 are disposed on a first surface 510 of the shell body 5, and respectively correspond to the positions of the hot jaws 231, neutral jaws 221, and ground jaws 211, respectively. The USB slot 54 is disposed on a second surface 520 of the shell body 5 different from the first surface 510.

In embodiments of the present invention, the numbers of the hot prong insertion slots 53, neutral prong insertion slots 52, ground prong insertion slots 51, and USB slots 54 may be chosen based on the size of the power supply adapter, and their numbers match the numbers of the corresponding jaws within the body.

By placing the USB slots 54 on a second surface 520 of the shell body 5 different from the first surface 510, the power supply adapter can be more flexibly used and more user friendly, because the USB slots 54 will not be blocked by large electrical plugs plugged into the other slots.

Figure 5B:
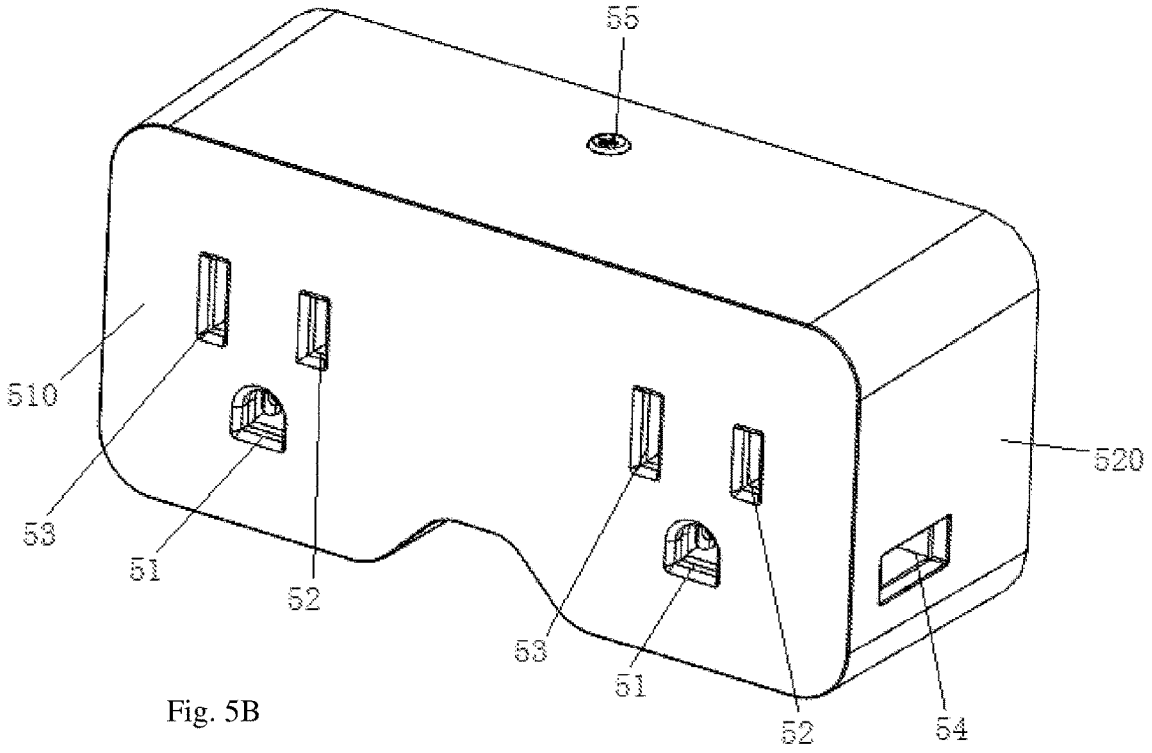

Further, as shown in FIG. 5B, the power supply adapter additionally includes a grounding test button 55, coupled to grounding test components disposed within the shell body 5 and electrically coupled to the circuit board 4, configured to test the grounding condition of the power supply adapter.

Before using the power supply adapter, the user may operate the grounding test button 55 to test whether the power supply adapter is properly grounded.

Figure 6A:
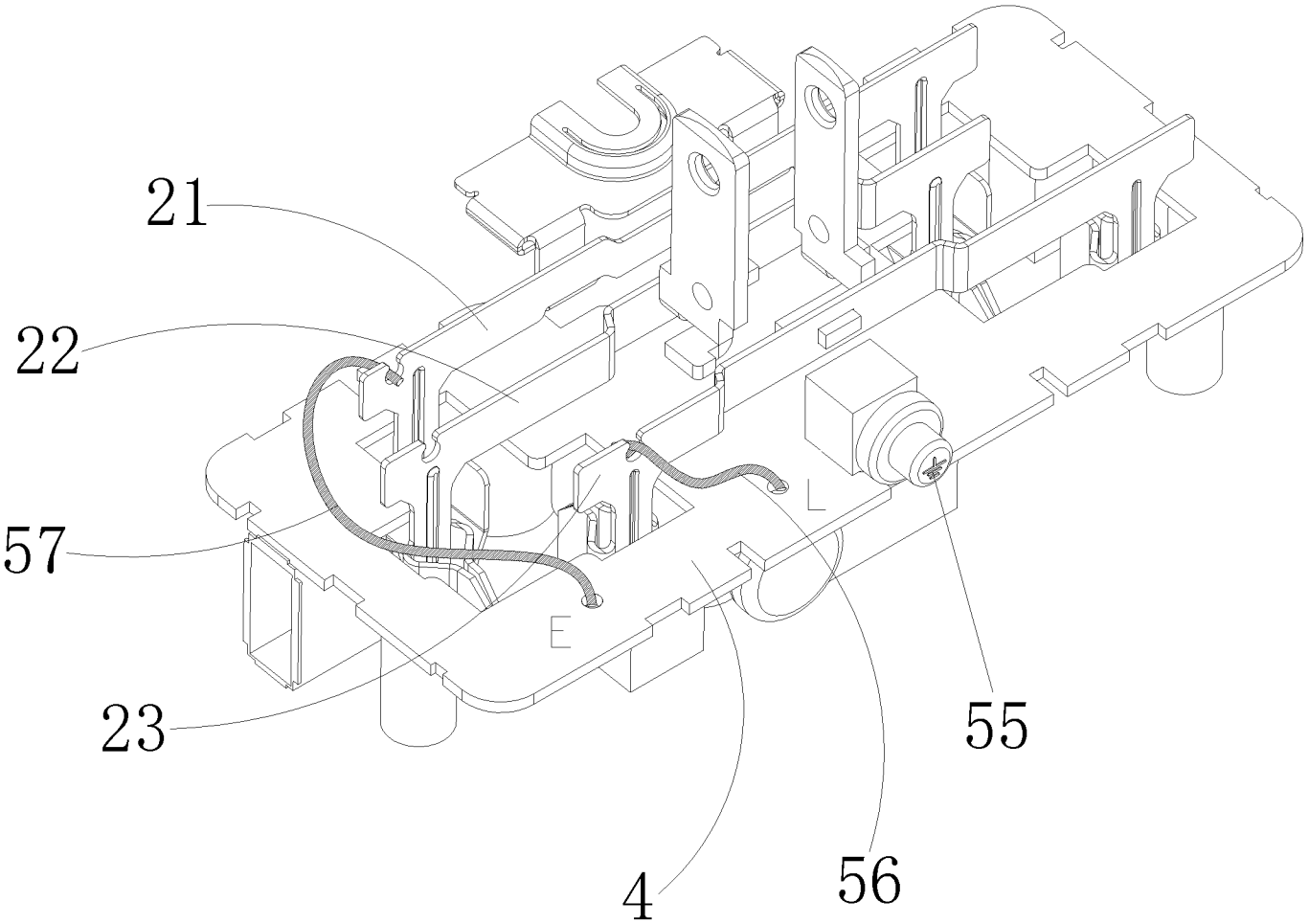
FIGS. 6A and 6B illustrate a grounding test circuit of the power supply adapter according to embodiments of the present invention.
Figure 6B:
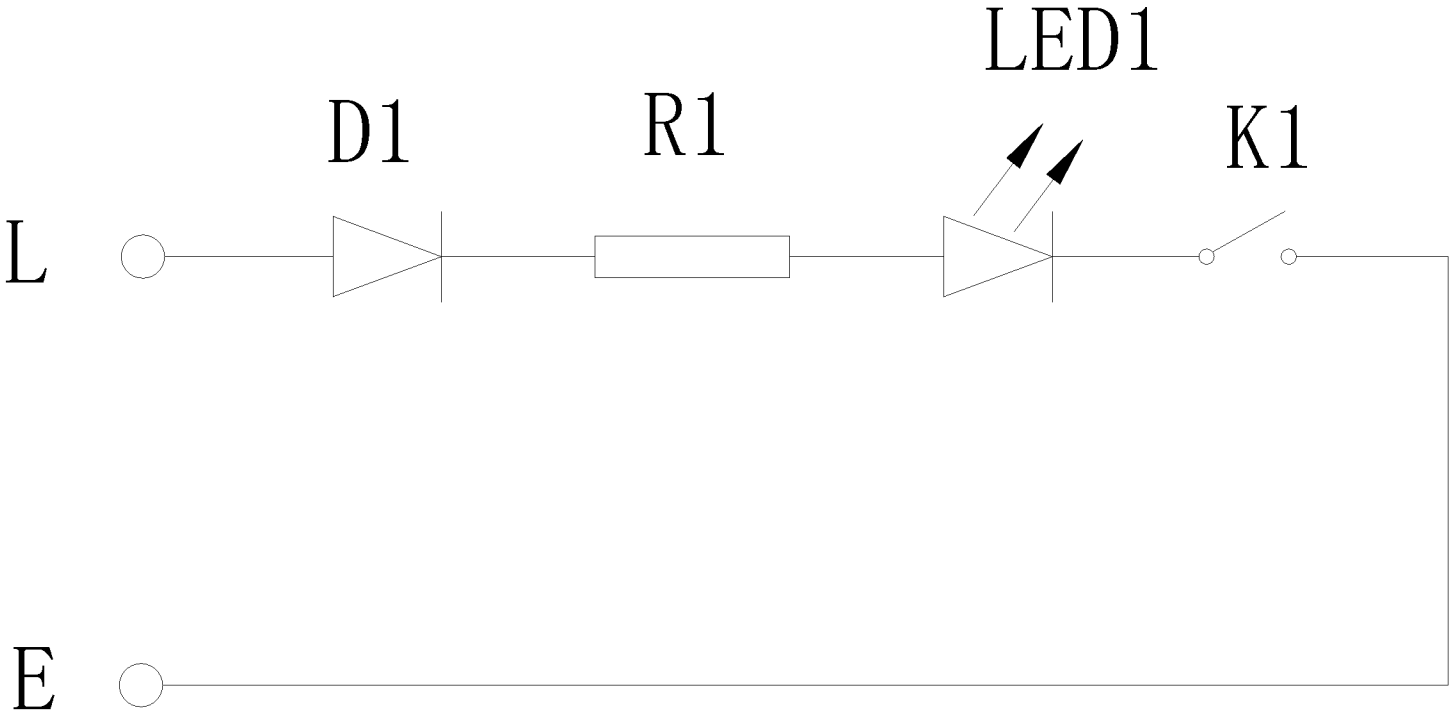

More specifically, as shown in FIGS. 6A and 6B, a grounding test circuit is provided on the circuit board 4, the grounding test circuit including a diode D1, a resistor R1, a light emitting diode LED1, and a switch K1 electrically coupled in series. The hot end L of the grounding test circuit (a connecting point on the circuit board 4) is coupled by a conductor wire 56 to the hot connector plate 23. The ground end E of the grounding test circuit (another connecting point on the circuit board 4) is coupled by another conductor wire 57 to the ground connector plate 21. The switch K is mechanically coupled to the grounding test button 55 to be operated by the button. After the power supply adapter is plugged into the two-prong socket 7 and the screw 6 passes through the ground ring 24 and screws into the ground hole 71, the grounding test button 55 will allow the user to test whether the power supply adapter is properly grounded. If the test button 55 is depressed to close the switch K1 and the light emitting diode illuminates, it indicates that the power supply adapter is properly grounded; otherwise, it indicates that the power supply adapter is not properly grounded.

The power supply adapter according to embodiments of the present invention solve the problem of lack of ground slots of conventional two-prong sockets. It further provides USB slots and a grounding test function, meeting the users' need for a safe and convenient power supply socket.

While the present invention is described above using specific examples, these examples are only illustrative and do not limit the scope of the invention. It will be apparent to those skilled in the art that various modifications, additions and deletions can be made to the power supply adapter of the present invention without departing from the spirit or scope of the invention.

What is claimed is:

1. A power supply adapter, adapted to be plugged into a two-prong socket, the power supply adapter comprising:

a base plate;

an electrical connector assembly, disposed on the base plate, and including a hot connector assembly, a neutral connector assembly, and a ground connector assembly, wherein the ground connector assembly is configured to be grounded to the two-prong socket when the power supply adapter is plugged into the two-prong socket;

a support frame, disposed to cover the electrical connector assembly and affixed to the base plate;

a circuit board, disposed on the support frame and electrically coupled to the electrical connector assembly; and a shell body disposed to cover the support frame and circuit board and affixed to the base plate.

2. The power supply adapter of claim 1, wherein the ground connector assembly includes:

a ground connector plate, having one or more ground jaws formed at one end which is configured to receive at least one prong of an electrical plug, and having a ground ring receiving member formed at another end;

a ground ring, removably disposed in the ground ring receiving member; and a ground screw, configured to press the ground connector plate and the ground ring into tight contact with each other, wherein when the power supply adapter is plugged into the two-prong socket, the ground screw is configured to be screwed into a ground hole of the two-prong socket to keep the ground connector plate and the ground ring in electrical contact with the ground hole of the two-prong socket, whereby the power supply adapter is grounded.

3. The power supply adapter of claim 2, wherein the hot connector assembly includes:

a hot connector plate, having one or more hot jaws formed at one end; and a hot insertion plate, having a hot prong formed at one end which is adapted to be inserted into an insertion slot of the two-prong socket, and having a first tab formed at another end which is coupled to the hot connector plate.

4. The power supply adapter of claim 3, wherein the neutral connector assembly includes:

a neutral connector plate, having one or more neutral jaws formed at one end; and a neutral insertion plate, having a neutral prong formed at one end which is adapted to be inserted into another insertion slot of the two-prong socket, and a second tab formed at another end which is coupled to the neutral connector plate.

5. The power supply adapter of claim 2, wherein a position of the ground ring relative to the ground ring receiving member is adjustable.

6. The power supply adapter of claim 4, wherein the shell body includes:

one or more hot prong insertion slots, disposed on a first surface of the shell body, each corresponding to a position of one of the one or more hot jaws;

one or more neutral prong insertion slots, disposed on the first surface of the shell body, each corresponding to a position of one of the one or more neutral jaws;

one or more ground prong insertion slots, disposed on the first surface of the shell body, each corresponding to a position of one of the one or more ground jaws; and at least one Universal Serial Bus (USB) slot, disposed on a second surface of the shell body which is different from the first surface.

7. The power supply adapter of claim 1, further comprising:

a grounding test circuit disposed within the shell body and electrically coupled to the circuit board, configured to test a grounding condition of the power supply adapter.

8. The power supply adapter of claim 2, wherein the ground ring receiving member includes:

a receiving plate configured to receive the ground ring;

a pair of clamps disposed respectively on two sides of the receiving plate, configured to secure the ground ring to the receiving plate; and a first receiving trough formed in the receiving plate, configured to cooperate with the ground ring and the ground screw.

9. The power supply adapter of claim 8, wherein the ground ring includes:

a ground ring plate; and a second receiving trough formed in the ground ring plate and configured to cooperate with the first receiving trough and the ground screw.

10. The power supply adapter of claim 9, wherein when the ground ring is disposed in the ground ring receiving member, the ground ring plate is affixed by the pair of clamps to the ground ring receiving member at a first position, and wherein the first receiving trough cooperates with the second receiving trough, and the ground screw is adapted to passes through the first receiving trough and the second receiving trough to be screwed into the ground hole of the two-prong socket.

* * * * *